US007230174B1

(12) United States Patent
Wilson

(10) Patent No.: US 7,230,174 B1
(45) Date of Patent: Jun. 12, 2007

(54) GUITAR AND VIOLIN HYBRID INSTRUMENT

(76) Inventor: Jonathan E. Wilson, 1107 Lucas St., San Fernando, CA (US) 91340

( * ) Notice: Subject to any disclaimer, the term of this patent is extended or adjusted under 35 U.S.C. 154(b) by 693 days.

(21) Appl. No.: 10/748,854

(22) Filed: Dec. 23, 2003

(51) Int. Cl.
*G10D 1/08* (2006.01)

(52) U.S. Cl. ..... 84/267

(58) Field of Classification Search ..... 84/725, 84/726, 731, 741, 730, 723, 735–738
See application file for complete search history.

(56) References Cited

U.S. PATENT DOCUMENTS 4,750,397 A * 6/1988 Ashworth-Jones ..... 84/731
5,347,905 A * 9/1994 Cipriani ..... 84/298
6,191,350 B1 * 2/2001 Okulov et al. ..... 84/646

* cited by examiner

*Primary Examiner*—Kimberly Lockett
(74) *Attorney, Agent, or Firm*—Albert O. Cota

(57) ABSTRACT

A guitar and violin hybrid instrument (10) comprising either a solid or hollow body (12). The body (12) has an upper surface (14), a lower surface (16), an upper end (18), a lower end (20), a left half (22), and a right half (24). Located on the body's (12) lower section is a leg contour (38) that provides a comfortable leg support. On the lower surface (16) is an electronics cavity (26) for housing an electronics circuit (130). Located on the body's (12) upper surface (14) is a plurality of magnetic pickups (G), control knobs for the operating the electronics circuit (130) and a bridge (42). Located on the bridge's (42) upper surface (44) is a plurality of piezoelectric pickups (Y). A neck (82) extends from the body's upper end (18). Attached to the neck's (82) upper surface (88) is a fretboard (104) on which a multiplicity of frets (112) are distributed. Located at the neck's (82) outer end (84) is a headstock (94) which has a plurality of tuning pegs (102) for adjusting the tension of a plurality of strings (126) that extend from the bridge (42), across the body (12) and over the magnetic pickups (G) to the tuning pegs (102).

24 Claims, 4 Drawing Sheets

GUITAR AND VIOLIN HYBRID INSTRUMENT

TECHNICAL FIELD

The present invention generally pertains to musical instruments, and more particularly, to a guitar and violin hybrid instrument that may be played to produce each sound individually or a combination of both sounds.

BACKGROUND ART

One of the most important goals for musicians, sound designers, music producers and instrument designers is to create new and unique sounds that can be used in songs, jingles, film and television soundtracks, etc. With the advent of the synthesizer in the mid-1960's and on to current electronic instruments and devices, the creation of new sounds has become significantly easier.

Before electrical devices, most musical instruments were limited to a specific type of tone. The design of the modem piano, for example, is credited to Bartolommeo Critofori, who built his harpsichord—derived instrument in 1709. The six-string acoustic guitar as we know it today, with the EADGBE tuning was developed in the late 1700's, from an original design having four "courses" (pairs of strings, tuned in unison) dating from the 1500's. Other stringed instruments such as the violin also date from the 1500's, but were derived from bowed instruments or even earlier designs. From the time of their initial designs, most instruments have changed very little as far as sound creation is concerned.

Due to their design and inherent abilities, electronic instruments are the preferred instruments to create new sounds or to mimic other instruments that are not readily available. If a typical "rock" band wants to include a flute or violin sound, they will usually use a synthesizer or a sampler/sample-playback device.

For many musicians, a well as those who simply enjoy listening to music, the sound of a flute or violin created and/or played in this manner is not an acceptable substitute. Although a synthesizer or sampler can produce an authentic sound, there are certain frequencies and harmonics that can only be produced when playing an actual metal flute or wooden violin.

There have been attempts at creating instruments that retain their original design but also can be utilized for modern functions. It is now common to see pianos, double bass, violins and other stringed and/or bowed instruments utilizing magnetic or piezoelectric pickups that permit electric amplification. Many wind instruments, such as the flute or a saxophone can have a microphone attached or be interfaced with a MIDI (Musical Instrument Digital Interface) device. Other attempts at allowing musicians greater flexibility is to combine two similar instruments, such as double-neck guitar which typically comprises an electric or acoustic six-string guitar with a bass guitar or 12-string guitar. While these types of instruments do allow a musician to play different sounds quickly and easily, the sound of each instrument remains the same.

What is needed is a means by which a musician can combine two or more sounds together, without utilizing a synthesizer or sampler. The ability to play individually or to combine the tones of two unique instruments, such as a guitar and a violin, from a single instrument would be extremely beneficial. A musician could choose which sound/tone he/she wanted to produce without the need to physically switch from one instrument to another. The sound of the acoustic or electric guitar being strummed or plucked or the sound of the bowed violin could be used. And, with the ability to morph or combine the two sounds together, a truly unique sound could be produced without the negative qualities the result from the use of electronic devices to create the sound.

A search of the prior art patents and industry literature did not disclose any musical instrument that read upon the claims of the instant invention. However, the following U.S. patents are considered related:

| U.S. Pat. No. | INVENTOR | ISSUED |
|---|---|---|
| 5,085,115 | Schlink | 4 Feb. 1992 |
| 4,311,078 | Falgares | 19 Jan. 1982 |

The U.S. Pat. No. 5,085,115 patent discloses a musical instrument having at least six strings tuned and fingered like an electric guitar, and having a symmetrically arched fingerboard, nut and bridge configuration to allow each string to be played individually with a violin bow. In addition, a transducer is mounted at the bridge to pickup the bowed sound and the arched double coil pick-up is mounted underneath the strings to pick up the plucked sound of the string. An adjustable support mechanism allows the instrument to be held so that the bow passes over the shoulder or clavicle.

The U.S. Pat. No. 4,311,078 patent discloses a guitar which, while being held in the traditional guitar playing position, may be strummed or bowed interchangeably. This is accomplished by constructing the nut, neck and bridge each to be formed having an arcuate surface to support the strings in an arcuate disposition. When the guitar is held in a vertical position, the corresponding upper edge of the nut, neck and bridge are raised so as to be greater in height than the opposite edge portions thereof. This arrangement locates the arcuate surface asymmetrically relative to the body of the instrument to support the strings either for strumming, plucking or bowing.

DISCLOSURE OF THE INVENTION

In its most basic design, the guitar and violin hybrid instrument is comprised of a body having an upper surface, a lower surface, a lower end, an upper end, a left half and a right half. On the body's lower surface is located an electronics cavity and a cavity cover. A plurality of control knob bores and either a single pickup bore or a plurality of pickup bores extend from the body's upper surface into the electronic cavity. Also, extending from the body into the cavity is a plurality of string attachment bores and a piezoelectric pickup bore. A bridge having a laterally-bowed upper surface is located on the body's upper surface. Along the bridge's upper surface is a plurality of saddle cavities into which is inserted and adjustably attached a plurality of saddles. Each saddle has a longitudinal string slot and a piezoelectric element cavity, into which is inserted a piezoelectric pickup. Also located on the body's upper surface is either a single magnetic pickup or a plurality of magnetic pickups, which extend from the respective pickup bore or bores.

Extending from the upper end of the body is a neck having an outer end, an inner end, an upper surface and a lower surface. At the neck's outer end is a headstock having an upper edge and a lower edge, and a plurality of tuning peg bores into which is inserted a plurality of tuning pegs. On the upper surface of the neck is a fretboard having an inner end and an outer end. Distributed between the fretboard's inner and outer ends are a multiplicity of frets and located between the neck and the headstock is a nut having a plurality of string grooves.

A set of strings are strung from the plurality of string attachment bores, across the body and the fretboard, through the grooves on the nut and onto the plurality of tuning pegs. One string is attached onto each tuning peg, and by tightening or loosening a tuning peg the tension and therefore the note, of each string can be adjusted.

Located within the electronic cavity is an electronics circuit, which controls the pickup selection, volume and other electronic functions of the instrument. When played, the instrument can be strummed or plucked as a guitar, or a bow can be used to produce the sound of a violin.

In view of the above disclosure, the primary object of the invention is to provide a musical instrument that can produce the sounds of a strummed or plucked guitar and the sounds of a bowed violin.

It is also an object of the invention to produce a musical instrument that:

- can be played to produce the sound of a guitar or a violin, or can produce a sound that is a combination of a guitar and a violin,
- can be made in either electric solid body or hollow body electric or acoustic designs,
- can be played in a standing position or in a sitting position, and
- can be designed to utilize a number of strings other than a traditional six-string guitar.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
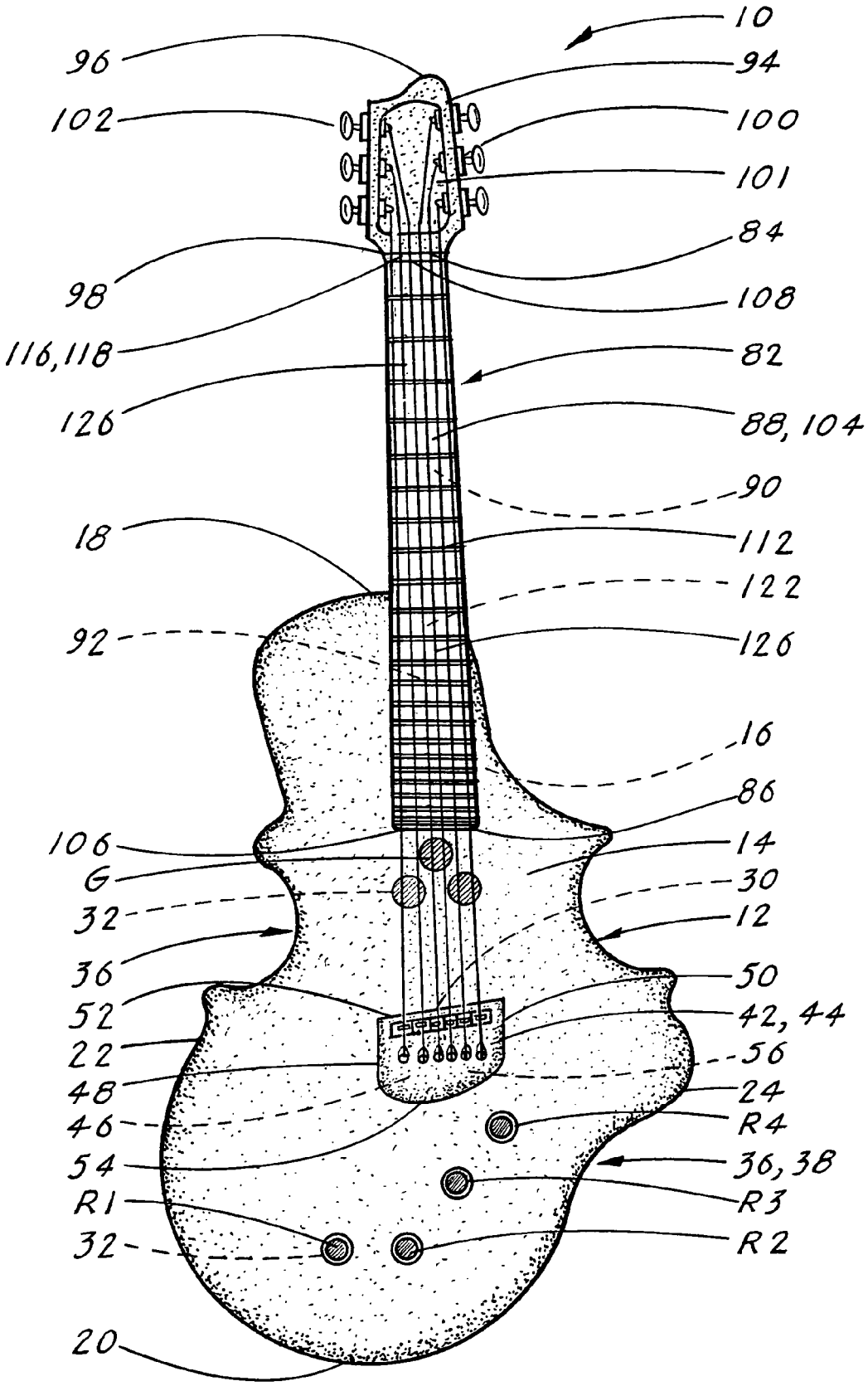
FIG. 1 is a front elevational view of the guitar and violin hybrid instrument.

The best mode for carrying out the invention is presented in terms of a preferred embodiment for a guitar and violin hybrid instrument 10, (hereinafter "the instrument 10"). By utilizing a combination of the designs of a conventional electric guitar and an electric violin, the instrument 10 is capable of producing a typical plucked or strummed electric guitar sound, a typical bowed electric violin sound or a unique hybrid sound that incorporates elements of both a guitar and violin. A person playing the instrument 10 also has the ability to choose the level, or amount, of each instrument when using the hybrid sound. For example, the guitar sound can be adjusted to approximately 30 percent of the whole sound, while the violin sound is utilized for the remaining 70 percent. As a result of this, the instrument is capable of producing a large number of traditional guitar and violin sounds, as well as combined sounds.

The instrument 10, as shown in FIGS. 1-6, is comprised of the following major elements: a body 12, a bridge 42, a neck 82 and an electronics circuit 130.

Figure 2:
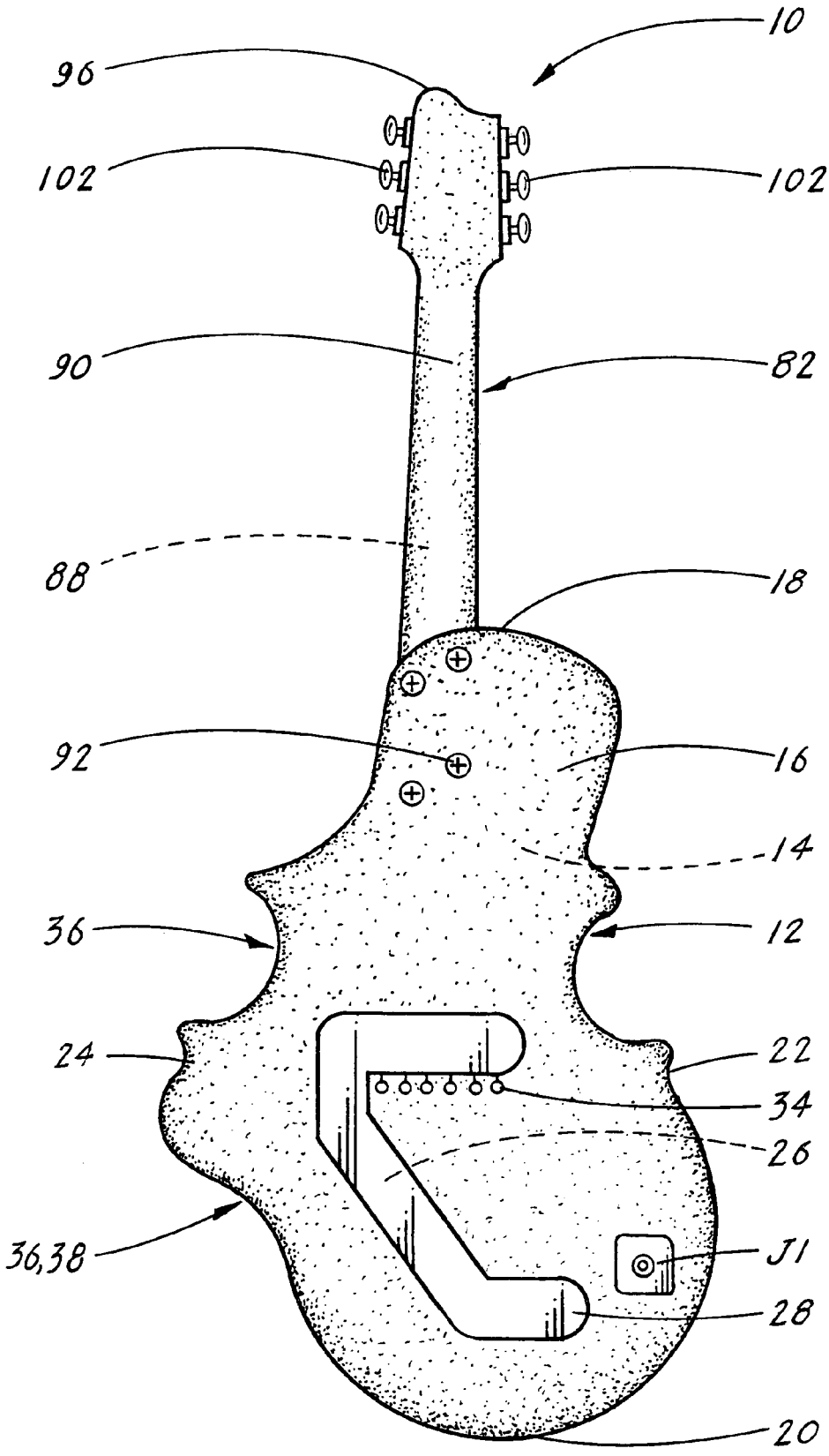
FIG. 2 is a rear elevational view of the guitar and violin hybrid instrument.

As shown in FIGS. 1 and 2, the body 12 is comprised of an upper surface 14, a lower surface 16, an upper end 18, a lower end 20, a left half 22 and a right half 24. Located on the body's lower surface 16 is an electronics cavity 26, which utilizes a removably attached cavity cover 28, as shown in FIG. 2. The body 12 further comprises a piezoelectric pickup bore 30, as well as a plurality of control knob bores and pickup bores 32. The bores extend from the upper surface 14 of the body 12 into the electronics cavity 26. Additionally, a plurality of string attachment bores 34 extend through the body 12 into the electronics cavity 26. As shown in FIGS. 1 and 2, the body 12 also comprises a plurality of contours 36 that are located around the perimeter of the body's left half 22 and right half 24. One of the plurality of contours 36 is comprised of a leg contour 38 which is located on a lower section of the body's left half 22. The specific leg contour 38 is designed to provide a comfortable leg support for the instrument 10 while the instrument is being played in a seated position. The instrument 10 shown in the figures consists of a solid body design, which is typically constructed of wood. If desired, the body can also be made in a hollow design, either without pickups and an electronics circuit, or with pickups and an electronics circuit. Normally, a design without pickups is known as an "acoustic" instrument, while a design with pickups is called an "electric" instrument. The design of the instrument 10 is adaptable to either type of construction, acoustic or electric.

Figure 3:
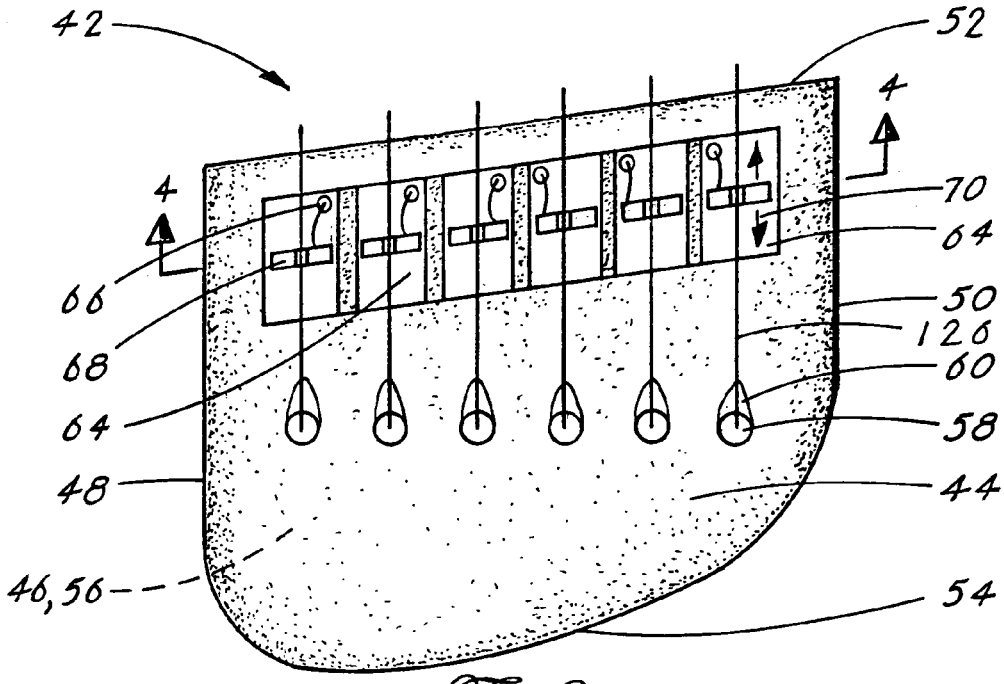
FIG. 3 is a top plan view of the bowed bridge.

As shown in FIGS. 1 and 3, the bridge 42 is comprised of a laterally-bowed upper surface 44 having a curvature radius of 2.0-3.0 inches (5.08-7.62 cm), a flat lower surface 46, a left side 48, a right side 50, a first end 52 and a second end 54. The flat lower surface 46 has means 56 for being attached to the upper surface 14 of the body 12. Typically, the attachment means 56 comprises an adhesive. It is important to note that the design and shape of the bridge's laterally-bowed upper surface 44 are what facilitate the instrument 10 being utilized as a violin-like instrument. Without the laterally-bowed upper surface 44, it would not be possible to play the instrument 44 with a bow.

Figure 4:
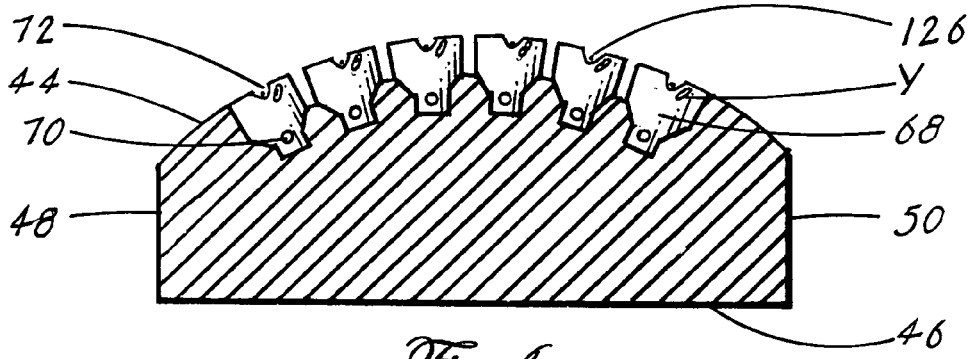
FIG. 4 is a cross-sectional view of the bowed bridge taken along the lines 44 of FIG. 3. This figure also shows a plurality of saddles inserted into a like plurality of saddle cavities.

The bridge 42 can be made of different materials such as wood, a composite material such as graphite, or plastic. As shown in FIG. 3, the bridge 42 also comprises a plurality of string bores 58 having a string slope 60 that slopes toward the first end 52. Each of the string bores 58 is in alignment with the plurality of string attachment bores 34 on the body 12. A plurality of saddle cavities 64, as shown in FIGS. 3 and 4, extend laterally across the left side 48 and right side 50, and adjacent the first end 52 of the bridge 42. Located in each saddle cavity 64 is a piezoelectric lead bore 66.

Figure 5:
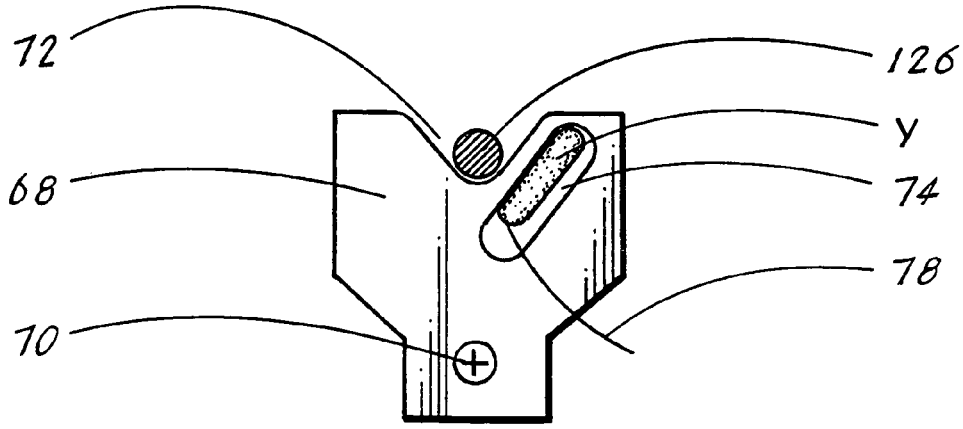
FIG. 5 is a front elevational of a saddle showing the placement of a string, a piezoelectric element with an extending electrical lead, and a saddle longitudinal positioning screw.

As shown in FIG. 4, a plurality of saddles 68 are inserted into the plurality of saddle cavities 64. As shown in FIG. 5, each saddle 68 has a positioning means 70 for being longitudinally positioned, an upper string groove 72, and a piezoelectric pickup cavity 74 that is located adjacent each of the string grooves 72.

Figure 6:
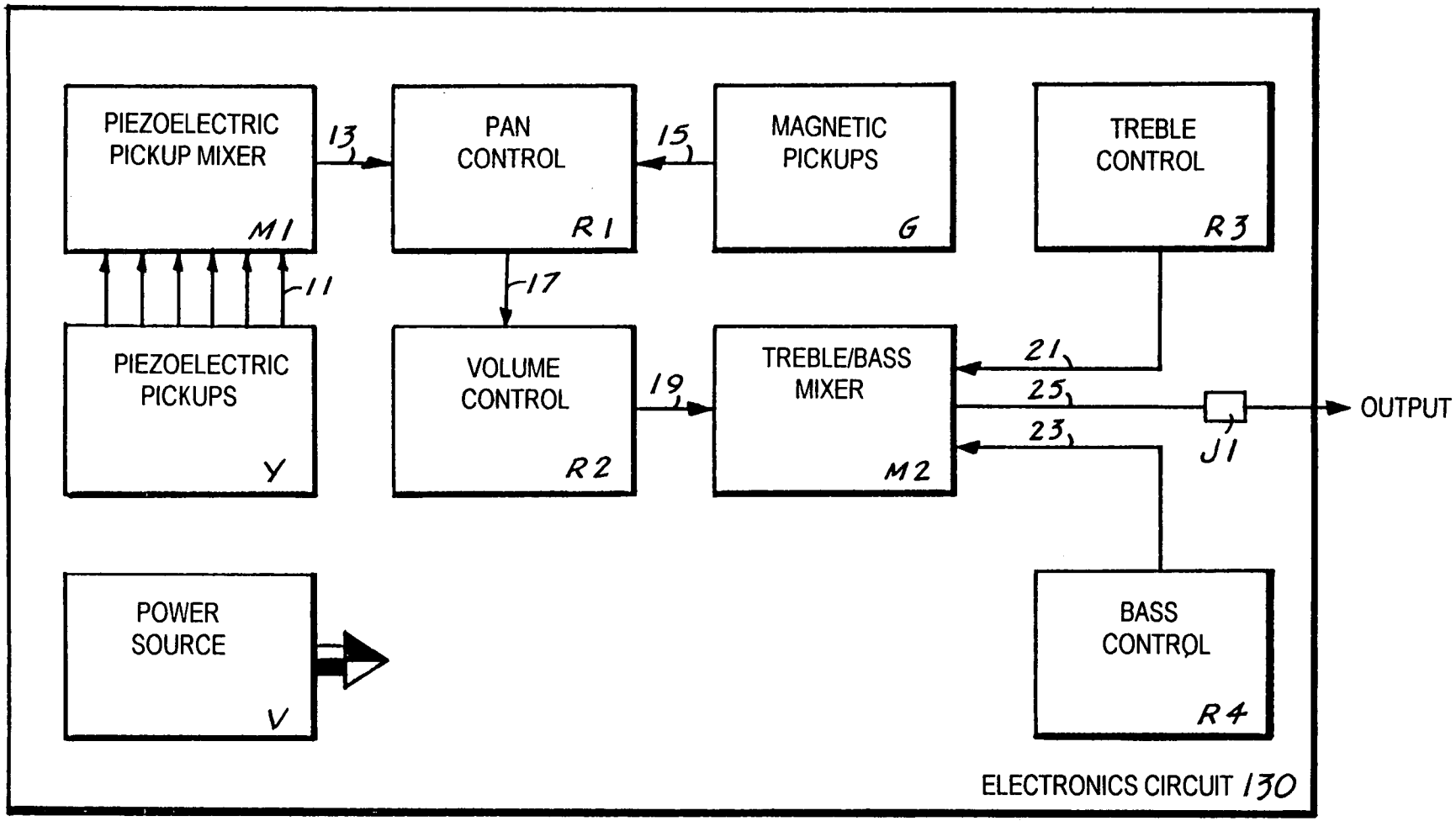
FIG. 6 is a block diagram of a typical electronics circuit that is utilized to operate the guitar and violin hybrid instrument.

As also shown in FIG. 5, a plurality piezoelectric pickups, which are designated by the letter Y, are inserted into each of the piezoelectric pickup cavities. Each piezoelectric pickup has an output lead 78 that is inserted sequentially through the respective piezoelectric lead bore 66 located on each saddle cavity 64, the piezoelectric pickup bore 30 located on the body 12, and into the electronics cavity 26 where it is operated by the electronics circuit 130, as shown in FIG. 6.

The neck 82, as shown in FIGS. 1 and 2, is comprised of an outer end 84, an inner end 86, an upper surface 88 and a lower surface 90. The neck's inner end 86 has means 92 for being attached to the upper surface 14, adjacent to the upper end 18 of the body 12. As also shown in FIGS. 1 and 2, a headstock 94 is comprised of an upper edge 96 and a lower edge 98. The headstock 94 is integrally formed with the outer end 84 of the neck 82. As shown in FIGS. 1 and 2, the headstock 94 further comprises a tuning peg cavity 101 having therethrough a plurality of tuning peg bores 100, into which are inserted a like plurality of tuning pegs 102. The tuning pegs are utilized to increase or decrease the tension of each string on the instrument 10, thus raising or lowering the note produced by each string.

As shown in FIG. 1, a fretboard 104 is comprised of an inner end 106 and an outer end 108. The fretboard 104 is dimensioned to fit over and be attached by an attachment means, such as an adhesive, to the upper surface 88 of the neck 82. A multiplicity of frets 112, as shown in FIG. 1, are distributed between the inner end 106 and the outer end 108 of the fretboard 104. Additionally, in an alternate design, (not shown), the neck 82 can be constructed without a fretboard 104. In this type of design, the frets 112 are distributed on the neck's 82 upper surface 88 between the outer end 84 and the inner end 86. The neck 82 is typically made from a hardwood, such as maple, or from a composite material, such as graphite. The fretboard 104 is preferably made of wood such as rosewood or paduk, or can also be made of a composite material.

As shown in FIG. 1, located between the outer end 84 of the neck 82 and the lower edge 98 of the headstock 94, is a nut 116 which has a plurality of string grooves 118.

The means 92 for attaching the inner end 86 of the neck 82 to the body 12 comprises an inward-extending step 122 that extends from the inner end 86 of the neck 82. The step 122 is dimensioned to allow the neck 82 to rest upon the upper surface and adjacent the upper end of the body 12, and be attached thereto by the attachment means 92, which typically comprises a set of screws, as shown in FIG. 2, or an adhesive, such as glue.

As shown in FIG. 1, a set of strings 126 is strung from the lower surface 16 of the body 12, through the plurality of string attachment bores 34, across the body 12 and the fretboard 104 through the plurality of string grooves 118 on the nut 116, and onto the plurality of tuning pegs 102 on the headstock 94.

The electronics circuit 130, as shown in FIG. 6 in a preferred design, is comprised of nine major elements: a plurality of piezoelectric pickups Y, a piezoelectric pickup mixer M1, a plurality of magnetic pickups G, a PAN control R1, a volume control R2, a treble control R3, a bass control R4, a treble/bass mixer M2, and a power source V.

The plurality of piezoelectric pickups Y are located and positioned on the like plurality of saddles 68, as best shown in FIG. 5. As previously described, the saddles 68 in turn, are inserted into the like plurality of saddle cavities 64 located on the bowed bridge 42, as shown in FIGS. 3 and 4. The piezoelectric pickups Y are designed and positioned to intercept the horizontal motion associated with the bowed vibrations produced by each of the strings. Each piezoelectric pickup Y has means for producing an output signal 11 that corresponds to the particular string 126 associated with the particular piezoelectric pickup Y. The output signal 11 produced from each of the piezoelectric pickups Y are applied to the piezoelectric pickup mixer M1, as shown in FIG. 6. The piezoelectric pickup mixer M1 has means for receiving each of the output signals 11 from the plurality of piezoelectric pickups Y and producing a balanced db output signal 13.

The plurality of magnetic pickups G, as shown in FIG. 6, are located and optimally positioned on the body 12 to intercept the vibrations produced by each of the strings 126. Each of the magnetic pickups G has means for producing a magnetic output signal 15 corresponding to the particular string associated with the particular magnetic pickup G.

The PAN control R1 is comprised of a variable resistor that is controlled by a PAN control knob accessible from the body 12. The control R1, as shown in FIG. 6, has a first input, a second input, and a PAN output signal 17. The first input is applied the balanced db output signal 13 from the pickup mixer M1, the second input is applied the magnetic output signals 15 from the plurality of magnetic pickups G. The PAN output signal 17 is dependent upon the position of the PAN control knob. When the PAN control knob is rotated fully clockwise (CW) the PAN output signal 17 is determined by the magnetic output signal 15 produced by the magnetic pickup (G), conversely when the PAN control knob is rotated fully counter-clockwise (CCW), the PAN output signal 17 is determined by the balanced db output signal 13 produced by the piezoelectric pickup mixer M1. When the PAN control knob is positioned midway between the CW and CCW positions, the PAN output signal 17 consists of a composite PAN output signal 17 that is comprised of both the outputs from the piezoelectric pickup mixer M1 and the magnetic pickup G.

The volume control R2, the treble control R3 and the bass control R4 are each comprised of a variable resistor that are controlled respectively by a volume control knob, a treble control knob and a bass control knob wherein each knob is accessible from the body. As shown in FIG. 6, the volume control R2 is applied the output signal 17 from the PAN control R1 and has an output consisting of a selectable db-level signal 19. The treble control R3 is designed to produce a selectable treble output signal 21, and the bass control R4 is designed to produce a selectable bass output signal 23.

The treble/bass mixer M2 has a first input that is applied the selectable db-level signal 19 from the volume control R2, a second input that is applied the selectable treble output signal 21 from the treble control R3, and a third input that is applied the bass output signal 23 from the bass control R4. The output of the treble/bass mixer M2 is comprised of a composite audio signal 25 that is applied, via an output jack J1, to an external audio amplifier.

The final element of the electronics circuit 130 is the power source V that is selected to supply the power levels required to power the electronic elements that comprise the electronic circuit 130. The power source is typically comprised of a 9-volt battery that is regulated to produce the required power levels.

The preferred design configuration of the electronics circuit 130 is as described above. However, a simplified design can also be utilized that is comprised of five major elements: a plurality of piezoelectric pickups Y, a piezoelectric pickup mixer M1, a plurality of magnetic pickups G, a PAN control R1, a volume control R2 and a power source V for supplying power to the piezoelectric pickup mixer M1. In this simplified design the output from the electronics circuit 130 is taken from the output of the volume control R2 which is applied, via the output jack J1, to an external audio amplifier.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A guitar and violin hybrid instrument comprising:

a) a body comprising:

(1) an upper surface, a lower surface, an upper end, a lower end, a left half and a right half, (2) an electronics cavity and cover located on the lower surface, (3) a piezoelectric pick-up bore, (4) a plurality of string attachment bores that extend through said body into the electronics cavity, and b) a bridge having:

(1) a laterally-bowed upper surface, a flat lower surface, having means for being attached to the upper surface of said body, a left side, a right side, a first end, a second end, a plurality of string bores in alignment with the plurality of string attachment bores on said body, and a piezoelectric lead bore in alignment with the piezoelectric pick-up bore on said body, (2) a plurality of saddles adjustably attached to the upper surface of said bridge, wherein each said saddle comprises a string groove and a piezoelectric pick-up cavity that is located adjacent each of the string slots, (3) a piezoelectric pick-up inserted into each said piezoelectric pick-up cavity wherein each said piezoelectric pick-up has an output lead that is inserted sequentially through the respective piezoelectric lead bore, the piezoelectric pick-up bore and into the electronics cavity, c) a neck comprising:

(1) an outer end, an inner end, an upper surface and a lower surface wherein the inner end having means for being attached to the upper surface adjacent to the upper end of said body, (2) a headstock having an upper edge and a lower edge, wherein the lower edge is integrally formed with the outer end of said neck, said headstock further having:

(a) a plurality of tuning pegs, (b) a fretboard having an inner end, an outer end and that is dimensioned to cover the upper surface of said neck, (c) a multiplicity of frets distributed between the inner end and the outer end of said fretboard, (d) a nut having a plurality of string grooves and that is located between the outer end of said neck and the lower edge of said headstock, d) a set of strings strung from said plurality of string attachment bores, across said body and said fretboard, through the plurality of string grooves on said nut and onto said plurality of tuning pegs that function to adjust the tension of said strings, e) an electronics circuit located within the electronics cavity, said circuit having means for controlling and operating said guitar and violin hybrid instrument, and f) a bow used to strum said set of strings when said instrument functions as a violin.

2. The electronics circuit as specified in claim 1 further comprising:

a) a plurality of piezoelectric pickups (Y) located and positioned on said bridge to intercept the vibrations produced by each of said strings, wherein each said piezoelectric pickup having means for producing an output signal corresponding to the particular string associated with the particular piezoelectric pickup, b) a piezoelectric pickup mixer (M1) having means for receiving each of the output signals from said plurality of piezoelectric pickups, and producing a balanced db output signal, c) a plurality of magnetic pickups (G) located and optimally positioned on said body to intercept the vibration produced by each of said strings, wherein each said magnetic pickup having means for producing a magnetic output signal corresponding to the particular string associated with the particular magnetic pickup, d) a PAN control (R1) that is operated by a PAN control knob, has a first input, a second input and a PAN output signal, wherein the first input is applied the balanced db output signal from said pickup mixer (M1), the second input is applied the magnetic output signals from said plurality of magnetic pickups (G1), wherein the PAN output signal is dependent upon the position of the PAN control knob, wherein when the PA control knob is rotated fully clockwise (CW) the PAN output signal is determined by the magnetic output signal produced by said magnetic pickup (G), conversely, when the PAN control knob is rotated fully counter-clockwise (CCW), the PAN output signal is determined by the output signal produced by said piezoelectric pickup mixer (M1), wherein when the PAN control knob is positioned midway between the CW and CCW positions, the PAN output signal is comprised of a composite PAN output signal that is further comprised of both the outputs from said piezoelectric pickup mixer (M1) and said magnetic pickup (G), e) a volume control (R2) having an input that is applied the output signal from said PAN control (R1) ad means for producing a selectable db-level signal, and f) a power source selected to supply the required power level to the pickup mixer (M).

3. The guitar and violin hybrid instrument as specified in claim 1 wherein said body is solid.

4. The guitar and violin hybrid instrument as specified in claim 1 wherein said body is hollow.

5. The guitar and violin hybrid instrument as specified in claim 1 wherein said body further comprises a plurality of contours located around the perimeter of said left half of said right half.

6. The guitar and violin hybrid instrument as specified in claim 5 wherein one of said plurality of contours is comprised of a leg contour located on a lower section of the left half, wherein said leg contour provides a comfortable leg support when playing the instrument.

7. The guitar and violin hybrid instrument as specified in claim 1 wherein said bridge is made of wood.

8. The guitar and violin hybrid instrument as specified in claim 1 wherein said bridge is made of a composite material.

9. The guitar and violin hybrid instrument as specified in claim 1 wherein said bridge is made of plastic.

10. The guitar and violin hybrid instrument as specified in claim 1 wherein the laterally-bowed upper surface of said bridge has a curvature radius of 2.0-3.0 inches (5.08-7.62 cm).

11. The guitar and violin hybrid instrument as specified in claim 1 wherein said neck is made of a hardwood or a composite material.

12. A guitar and violin hybrid instrument comprising:

a) a body comprising:

(1) an upper surface, a lower surface, an upper end, a lower end, a left half and a right half, (2) an electronics cavity located on the lower surface, (3) a removably attached cavity cover, (4) a piezoelectric pick-up bore, (5) a plurality of control knob bores and pickup bores, wherein the bores extend from the upper surface into the electronics cavity, (6) a plurality of string attachment bores that extend through said body into the electronics cavity, and b) abridge having:

(1) a laterally-bowed upper surface, a flat lower surface having means for being attached to the upper surface of said body, a left side, a right side, a first end, and second end, (2) a plurality of string bores having a string slope that slopes toward the first end, wherein said string bores are in alignment with the plurality of string attachment bores on said body, (3) a plurality of saddle cavities that extend laterally across the left and right sides and adjacent the first end, wherein each said saddle cavity having a piezoelectric lead bore, c) a plurality of saddles inserted into the plurality of saddle cavities, wherein each said saddle having:

(1) means for being longitudinally positioned, (2) an upper longitudinal string groove, (3) a piezoelectric pick-up cavity located adjacent each of the string grooves, and d) a plurality of piezoelectric pick-ups inserted into each of the piezoelectric pick-up cavities, wherein each said piezoelectric pick-up has an output lead that is inserted sequentially through the respective piezoelectric lead bore located on said saddle cavity, the piezoelectric pick-up bore located on said body and into the electronics cavity, e) a neck comprising:

(1) an outer end, an inner end, an upper surface and a lower surface wherein the inner end having means for being attached to the upper surface, adjacent to the upper end, of said body, (2) a headstock having an upper edge and a lower edge, wherein the lower edge is integrally formed with the outer end of said neck, said headstock further having a plurality of tuning peg bores into which are inserted a like plurality of tuning pegs, (3) a fretboard having an inner end, an outer end and that is dimensioned to fit over and be attached by an attachment means to the upper surface of said neck, (4) a multiplicity of frets distributed between the inner end and the outer end of said fretboard, (5) a nut having a plurality of string grooves and that is located between the outer end of said neck and the lower edge of said headstock, f) a set of strings strung from the lower surface of said body, through said plurality of string attachment bores, across said body and said fretboard, through the plurality of string grooves on said nut and onto said plurality of tuning pegs that function to adjust the tension of said strings, g) an electronics circuit located within the electronics cavity, said circuit comprising:

(1) said plurality of piezoelectric pickups (Y) located and positioned on said bridge to intercept the horizontal motion associated with the bowed vibrations produced by each of said strings, wherein each said piezoelectric pickup having means for producing an output signal corresponding to the particular string associated with the particular piezoelectric pickup, (2) a piezoelectric pickup mixer (M1) having means for receiving each of the output signals from said plurality of piezoelectric pickups, and producing a balanced db output signal, (3) a plurality of magnetic pickups (G) located and optimally positioned on said body to intercept the vibration produced by each of said strings, wherein each said magnetic pickup having means for producing a magnetic output signal corresponding to the particular string associated with the particular magnetic pickup, (4) a PAN control (R1) that is operated by a PAN control knob, has a first input, a second input and a PAN output signal, wherein the first input is applied the balanced db output signal from said pickup mixer (M1), the second input is applied the magnetic output signals from said plurality of magnetic pickups (G1), wherein the PAN output signal is dependent upon the position of the PAN control knob, wherein when the PAN control knob is rotated fully clockwise (CW) the PAN output signal is determined by the magnetic output signal produced by said magnetic pickup (G), conversely, when the PAN control knob is rotated fully counter-clockwise (CCW), the PAN output signal is determined by the output signal produced by said piezoelectric pickup mixer (M1), wherein when the PAN control knob is positioned midway between the CW and CCW positions, the PAN output signal is comprised of a composite PAN output signal that is further comprised of both the outputs from by said piezoelectric pickup mixer (M1) and said magnetic pickup (G), (5) a volume control (R2) having an input that is applied the output signal from said PAN control (R1) and means for producing a selectable db-level signal, (6) a treble control (R3) that is operated by a treble control knob that is positioned to produce a selectable treble output signal, (7) a bass control (R4) that is operated by a bass control knob that is positioned to produce a selectable bass output signal, (8) a treble/bass mixer (M2) having a first input that is applied the selectable db-level signal from said volume control (R2), a second input that is applied the selectable treble output signal from said treble control (R3), a third input that is applied the bass output signal from said bass control (R4), and an output consisting of a composite audio signal that is applied via an output jack to an external audio amplifier, and (9) a power source selected to supply the power levels required to power the electrical elements of said electronic circuit, and h) a bow used to strum said set of strings when said instrument functions as a violin.

13. The guitar and violin hybrid instrument as specified in claim 12 wherein said body further comprises a plurality of contours located around the perimeter of said left half and said right half.

14. The guitar and violin hybrid instrument as specified in claim 13 wherein one of said plurality of contours is comprised of a leg contour located on a lower section of the left half, wherein said leg contour provides a comfortable leg support for the instrument while the instrument in being played in a seated position.

15. The guitar and violin hybrid instrument as specified in claim 12 wherein said body is solid.

16. The guitar and violin hybrid instrument as specified in claim 12 wherein said body is hollow.

17. The guitar and violin hybrid instrument as specified in claim 12 wherein said bridge is made of wood.

18. The guitar and violin hybrid instrument as specified in claim 12 wherein said bridge is made of a composite material.

19. The guitar and violin hybrid instrument as specified in claim 12 wherein said bridge is made of plastic.

20. The guitar and violin hybrid instrument as specified in claim 12 wherein the laterally-bowed upper surface of said bridge has a curvature radius of 2.0-3.0 inches (5.08-7.62 m).

21. The guitar and violin hybrid instrument as specified in claim 12 wherein said means for attaching the inner end of said neck to said body comprises an inward-extending step that extends from the inner end of said neck, wherein said step is dimensioned to allow said neck to rest upon the upper surface and adjacent the upper end of said body and be attached thereto by the attachment means.

22. The guitar and violin hybrid instrument as specified in claim 21 wherein said neck attachment means comprises an adhesive.

23. The guitar and violin hybrid instrument as specified in claim 21 wherein said neck attachment means comprises a set of screws.

24. The guitar and violin hybrid instrument as specified in claim 12 wherein the power source that is utilized to supply the required power levels to the powered elements is comprised of a 9-volt battery.

* * * * *